US007604050B2

(12) United States Patent
Dallas et al.

(10) Patent No.: US 7,604,050 B2
(45) Date of Patent: Oct. 20, 2009

(54) WELLHEAD AND CONTROL STACK PRESSURE TEST PLUG TOOL

(75) Inventors: L. Murray Dallas, Streetman, TX (US); Bob McGuire, Moore, OK (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 0 days.

(21) Appl. No.: 12/112,283

(22) Filed: Apr. 30, 2008

(65) Prior Publication Data

US 2008/0251251 A1 Oct. 16, 2008

Related U.S. Application Data

(62) Division of application No. 11/699,264, filed on Jan. 29, 2007, now Pat. No. 7,516,786, which is a division of application No. 10/799,085, filed on Mar. 12, 2004, now Pat. No. 7,207,384.

(51) Int. Cl.
*E21B 47/10* (2006.01)
*G01M 3/02* (2006.01)

(52) U.S. Cl. ..... 166/250.08; 166/75.13; 73/46

(58) Field of Classification Search ..... 166/124, 166/135, 192, 75.13, 202, 368, 250.08; 285/123.1; 277/335; 73/40.5 R, 46, 49.1
See application file for complete search history.

(56) References Cited

U.S. PATENT DOCUMENTS

| | | | | |
|---|---|---|---|---|
| 1,944,573 | A | 1/1934 | Raymond et al. | |
| 2,067,499 | A | 1/1937 | Millmine | |
| 2,334,303 | A | 11/1943 | Allen et al. | |
| 2,478,628 | A | 8/1949 | Hansen | |
| 2,540,322 | A | 2/1951 | Christensen | |
| 2,902,094 | A | 9/1959 | Nelson et al. | |
| 2,951,363 | A | 9/1960 | Diodene | |
| 2,981,331 | A * | 4/1961 | Arterbury | 166/250.08 |
| 3,093,996 | A | 6/1963 | Jones | |
| 3,177,703 | A | 4/1965 | Waters et al. | |
| 3,189,099 | A | 6/1965 | Otteman et al. | |
| 3,404,736 | A | 10/1968 | Nelson et al. | |
| 3,897,824 | A | 8/1975 | Fisher | |
| 4,018,726 | A | 4/1977 | Bode | |
| 4,058,162 | A | 11/1977 | Smith | |
| 4,121,660 | A | 10/1978 | Koleilat | |
| 5,775,422 | A | 7/1998 | Wong et al. | |
| 6,220,363 | B1 | 4/2001 | Dallas | |
| 6,247,537 | B1 | 6/2001 | Dallas | |

(Continued)

*Primary Examiner*—Kenneth Thompson
(74) *Attorney, Agent, or Firm*—Nelson Mullins Riley & Scarborough, LLP

(57) ABSTRACT

A test plug tool for use in testing a pressure integrity of a pressure control stack mounted to a wellhead, including a joint between a casing and a casing support in the wellhead. The test plug tool includes a test plug of an appropriate diameter used to pressure test the pressure control stack as well as a joint between any one of a surface casing and the wellhead, an intermediate casing and an intermediate casing mandrel, and a production casing and a production casing mandrel. The pressure integrity of the wellhead is ensured at each stage of well drilling and well completion, and safety is improved. Optionally, a backpressure valve permits pressurized fluid that leaks below the test plug tool to flow upwardly through a central bore in a landing tool that is secured to the test plug tool to permit detection of the leak.

20 Claims, 8 Drawing Sheets

U.S. PATENT DOCUMENTS

| | | | |
|---|---|---|---|
| 6,289,993 | B1 | 9/2001 | Dallas |
| 6,364,024 | B1 | 4/2002 | Dallas |
| 6,447,021 | B1 | 9/2002 | Haynes |
| 6,491,098 | B1 | 12/2002 | Dallas |
| 6,626,245 | B1 | 9/2003 | Dallas |
| 6,695,064 | B2 | 2/2004 | Dallas |
| 6,712,147 | B2 | 3/2004 | Dallas |
| 6,817,421 | B2 | 11/2004 | Dallas |
| 6,820,698 | B2 | 11/2004 | Haynes |
| 6,918,441 | B2 | 7/2005 | Dallas |
| 6,918,446 | B2 | 7/2005 | Borak |
| 7,055,632 | B2 | 6/2006 | Dallas |
| 7,159,663 | B2 | 1/2007 | McGuire et al. |
| 2002/0174991 | A1 | 11/2002 | Borak |

* cited by examiner

WELLHEAD AND CONTROL STACK PRESSURE TEST PLUG TOOL

CROSS-REFERENCE TO RELATED APPLICATIONS

This is a Division of U.S. patent application Ser. No. 11/699,264 filed Jan. 29, 2007 now U.S. Pat. No. 7,516,786, which issued Apr. 14, 2009, which is a division of U.S. patent application Ser. No. 10/799,085 filed Mar. 12, 2004, now U.S. Pat. No. 7,207,384, which issued Apr. 24, 2007.

MICROFICHE APPENDIX

Not Applicable.

TECHNICAL FIELD

The invention relates generally to pressure-testing tools for pressure control stacks on wellheads and, in particular, to test plug tools for pressure-testing of those control stacks.

BACKGROUND OF THE INVENTION

Prior art pressure-test plug tools for testing the pressure integrity of pressure control stacks on wellheads are well known in the art. The pressure-test plug tools are used to test the pressure integrity of control stack components such as blowout preventers, valves, tees, etc., and joints between the components prior to drilling or stimulating a well.

While most prior art test plug tools are known to function well, they all suffer from a drawback in that they are only designed to test the pressure integrity of the stack above a casing joint, i.e., above a connection between a casing and a casing support. With prior-art devices, the pressure integrity of the casing joint cannot be verified. During well stimulation operations, where fluid pressures may spike to 20,000 PSI, this joint may be susceptible to leakage and/or failure, resulting in expensive repairs, cleanup, downtime and potential environmental damage.

Many configurations for pressure-test plug tools have been invented. For example, in U.S. Pat. No. 5,775,422 (Wong et al.) entitled TREE TEST PLUG, the test plug is lodged within the tubing hanger, i.e., above the connection between the surface casing and the wellhead. In this configuration, the pressure integrity of the stack beneath the tubing hanger cannot be verified.

In U.S. Pat. No. 4,121,660 (Koleilat) entitled WELL PRESSURE TEST PLUG, the test plug is seated in the bore of the wellhead. With the test plug in this configuration, the pressure integrity of the wellhead-to-casing joint cannot be tested.

Similarly, in U.S. Pat. No. 4,018,276 (Bode) entitled BLOWOUT PREVENTER TESTING APPARATUS, the test plug is positioned in the bore of the wellhead. The position of the test plug permits pressure-testing of the blowout preventer but does not permit pressure-testing of the wellhead or the casing connection.

Likewise, in U.S. Pat. No. 3,897,824 (Fisher) entitled BLOWOUT PREVENTER TESTING APPARATUS, the test plug is positioned in the bore of the wellhead beneath the blowout preventer. With the test plug in this location, it is not possible to verify the pressure integrity of the lower part of the wellhead, such as the joint between the wellhead and the well casing.

In U.S. Pat. No. 3,177,703 (Waters et al.) entitled METHOD AND APPARATUS FOR RUNNING AND TESTING AN ASSEMBLY FOR SEALING BETWEEN CONDUITS, the test plug is positioned in the bore of the wellhead above the joint between the wellhead and the casing. With the test plug in this location, it is not possible to pressure-test the wellhead- casing joint.

In U.S. Pat. No. 2,951,363 (Diodene) entitled TOOL FOR TESTING WELL HEAD EQUIPMENT, the test plug is also positioned above the wellhead and casing joint. Pressure-testing of the casing joint is not possible with the test plug located in that position.

There therefore exists a need for a test plug tool for pressure-testing wellhead control stacks that permits testing of the pressure integrity of a casing joint, i.e., the joint between a surface casing and a wellhead, the joint between an intermediate casing and an intermediate casing mandrel, or the joint between a production casing and a production casing mandrel.

SUMMARY OF THE INVENTION

It is therefore an object of the invention to provide a test plug tool for use in testing a pressure integrity of a joint between a casing and a casing support that secures the casing to the wellhead stack assembly, the test plug tool providing a fluid-tight seal with the casing beneath the joint between the casing and the casing support.

The invention provides a test plug tool for use in testing a pressure integrity of a pressure control stack mounted to a wellhead, including testing the pressure integrity of a joint between a casing and a casing support that secures the casing to a wellhead stack assembly, the test plug tool providing a high pressure seal with the casing below the joint between the casing and the casing support, the test plug tool comprising: a test plug hanger and a test plug, the test plug hanger including a hanger flange at a top end thereof and a test plug support leg that depends from the hanger flange and includes a bottom end for supporting the test plug in the casing; an axial passageway bored through a central portion of the test plug hanger, the axial passageway permitting pressurized fluid that may have leaked past the test plug to flow upwardly through the central portion of the test plug hanger; and a backpressure valve in fluid communication with the axial passageway, the backpressure valve throttling the pressurized fluid flowing upwardly through the test plug hanger.

The invention further provides a test plug tool for use in testing a pressure integrity of a pressure control stack mounted to a wellhead, including testing the pressure integrity of a joint between a casing and a casing support that secures the casing to a wellhead stack assembly, the test plug tool providing a high pressure seal with the casing below the joint between the casing and the casing support, the test plug tool comprising: a test plug hanger and a test plug, the test plug hanger including a hanger flange at a top end thereof and a test plug support leg that depends from the hanger flange and includes a bottom end for supporting the test plug in the casing; an axial passageway bored through a central portion of the test plug hanger, the axial passageway permitting pressurized fluid that may have leaked past the test plug to flow upwardly through the central portion of the test plug hanger; and a backpressure valve in fluid communication with the axial passageway, the backpressure valve throttling the pressurized fluid flowing upwardly through the test plug hanger.

The invention yet further provides a method for testing a pressure integrity of a pressure control stack mounted to a wellhead, comprising: using a landing tool to insert a test plug into the wellhead stack assembly and testing the pressure integrity of a joint between a casing and a casing support that secures the casing to the wellhead stack assembly using the test plug tool, which provides a high pressure seal with the casing below the joint between the casing and the casing support; landing the test plug in the casing beneath the joint between the casing and the casing support; locking the test plug tool in the position in which the test plug is beneath the joint between the casing and the casing support; pressurizing the wellhead stack assembly; and monitoring a top end of the landing tool for pressurized fluid flowing upwardly through a backpressure valve into a central bore of the landing tool to determine whether pressurized fluid is leaking past the test plug.

The invention also provides a test plug tool for use in testing a pressure integrity of a pressure control stack mounted to a wellhead, including testing the pressure integrity of a joint between a casing and a casing support that secures the casing to the wellhead stack assembly, the test plug tool comprising: a test plug hanger for suspending the test plug tool in the pressure control stack, the test plug hanger including a fluid passage to permit test fluid to pass therethrough; a test plug leg connected to an underside of the test plug hanger; a test plug connected to a bottom end of the test plug leg, the test plug having a sealing element for providing a high-pressure fluid seal with the casing when the test fluid is injected into the wellhead stack assembly; an axial passageway through a central portion of the test plug hanger, the axial passageway permitting pressurized fluid that may have leaked past the test plug to flow upwardly through the axial passageway; and a backpressure valve in fluid communication with the axial passageway, the backpressure valve throttling the pressurized fluid flowing upwardly through the axial passageway.

BRIEF DESCRIPTION OF THE DRAWINGS

Further features and advantages of the invention will become apparent from the following detailed description, taken in combination with the appended drawings, in which.

It will be noted that throughout the appended drawings, like features are identified by like reference numerals.

DETAILED DESCRIPTION OF PREFERRED EMBODIMENTS

In general, and as will be explained below, a test plug tool can be used for testing the pressure integrity of a wellhead having a pressure control stack mounted thereto. The wellhead and the pressure control stack will be referred to hereinafter as a "wellhead stack assembly". The test plug of the test plug tool is designed to be landed below a casing joint formed between a casing and a casing support so that this casing joint and all joints above it in the pressure control stack can be pressure-tested. The expression "casing joint" as used in this specification means a joint between a casing and a casing support. A "casing", as persons skilled in the art will understand, includes a surface casing, an intermediate casing and a production casing. A "casing support" means a component of the wellhead stack assembly that holds and/or secures the casing to the wellhead stack assembly, and suspends the casing in a well bore. Persons skilled in the art will understand that where the casing is surface casing, the casing support is typically a wellhead. Where the casing is an intermediate casing, the casing support is generally an intermediate casing mandrel. Where the casing is production casing, the casing support is generally a production casing mandrel.

By constructing test plugs of suitable diameter, the test plug tool can be used to pressure-test the surface casing, the intermediate casing or the production casing. The test plug tool includes a test plug hanger with fluid passages to permit test fluids to pass therethrough, a test plug leg that extends downwardly from the test plug hanger to support a test plug. In one embodiment, the test plug is a cup tool that includes a cup sleeve which terminates in a bullnose, the cup sleeve supports, above an annular abutment, a gauge ring, an elastomeric sealing element and an elastomeric cup. The gauge ring, sealing element and cup are dimensioned to provide a high-pressure fluid seal against an inside of the casing. During operation, the valves of the pressure control stack are closed, the side ports are plugged and the stack is pressurized to at least an estimated operating pressure to verify that all seals and joints, including the casing joint, are able to withstand the estimated operating pressure.

Figure 1:
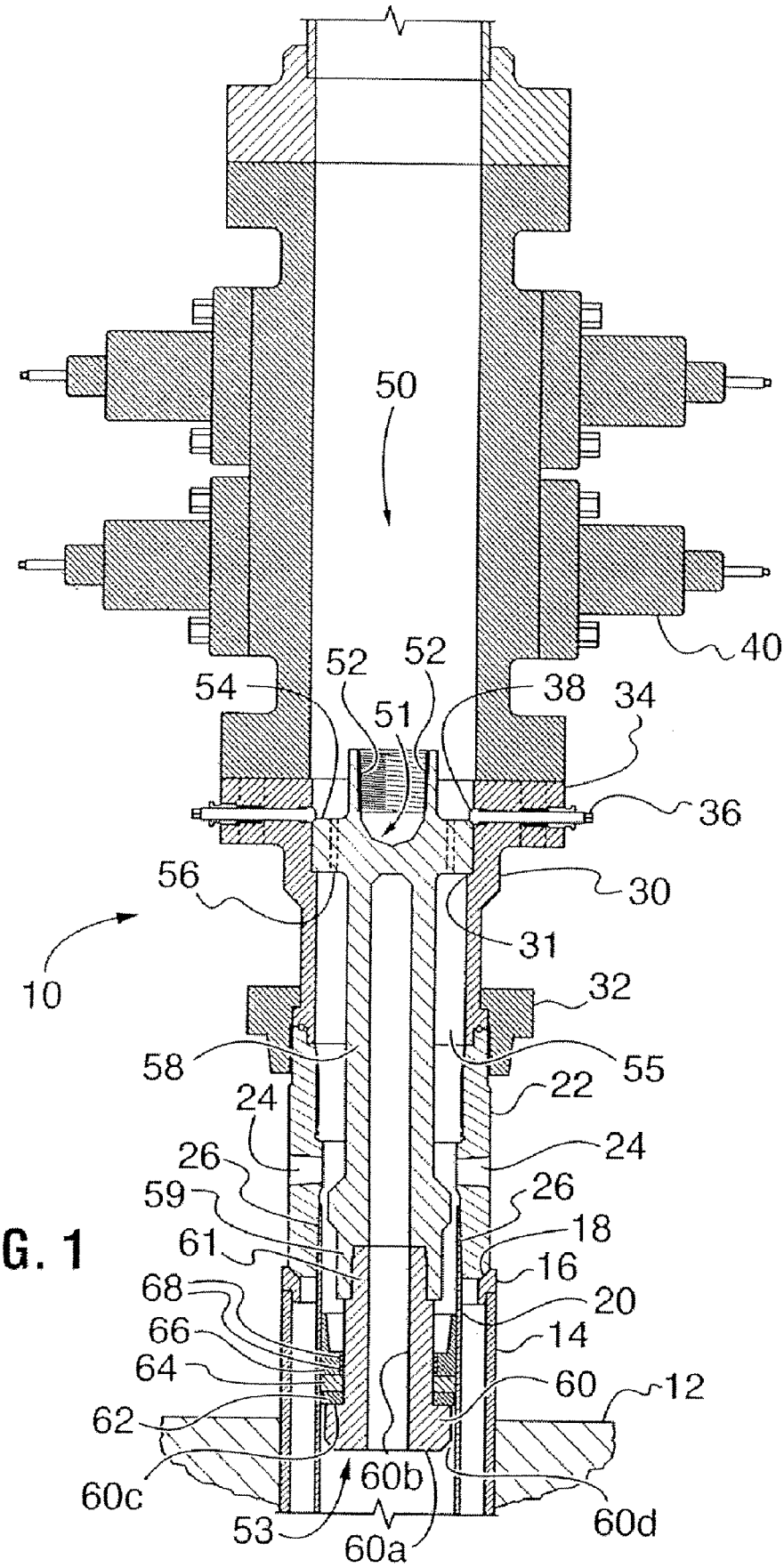
FIG. 1 is a cross-sectional view of a wellhead with a control stack attached thereto and showing a test plug tool in accordance with the invention with the test plug landed in the surface casing beneath the joint between the surface casing and the wellhead.

FIG. 1 illustrates what is known in the art as a pressure control stack 10 [hereinafter the "stack"] which is configured for pressure integrity testing. The expression "pressure integrity testing" as used in this specification means a testing procedure during which the stack is pressurized to at least an estimated operating pressure and the joints and seals are inspected to verify that they have withstood the test pressure.

At the base of the stack 10, and dug into the ground 12, is a conductor 14. The conductor 14 is installed, or "stuffed", into a "rat-hole" that is typically bored 60 to 80 feet deep, depending on subsurface conditions. The conductor 14 supports a conductor ring 16 on the upper lip of the conductor. The conductor ring 16 is beveled to form a bowl-shaped receptacle 18 for receiving a bottom beveled portion of a wellhead 22. A surface casing 20 is connected to the wellhead 22 below the side ports 24 of the wellhead. The side ports 24 are sealed during pressure-testing.

The surface casing 20 is joined to the wellhead 22 at a wellhead-to-casing joint 26. The wellhead-to-casing joint 26 is formed between an upper portion of the surface casing 20 and a lower portion of the wellhead 22, as illustrated in FIG. 1.

As shown in FIG. 1, mounted atop the wellhead 22 is a drilling flange 30 which is secured to an upper portion of the wellhead 22 by a wing nut 32. The drilling flange 30 has transverse bores in a flanged portion 34 that house locking pins 36. Each locking pin has a head 38. Mounted atop the drilling flange 30 is a blowout preventer 40, well known in the art.

Before the stack is pressurized, a test plug tool 50 is inserted into the bore of the stack 10. The test plug tool 50 includes a test plug hanger 51 and a test plug 53 which are interconnected by a test plug leg 58.

Figure 1A:
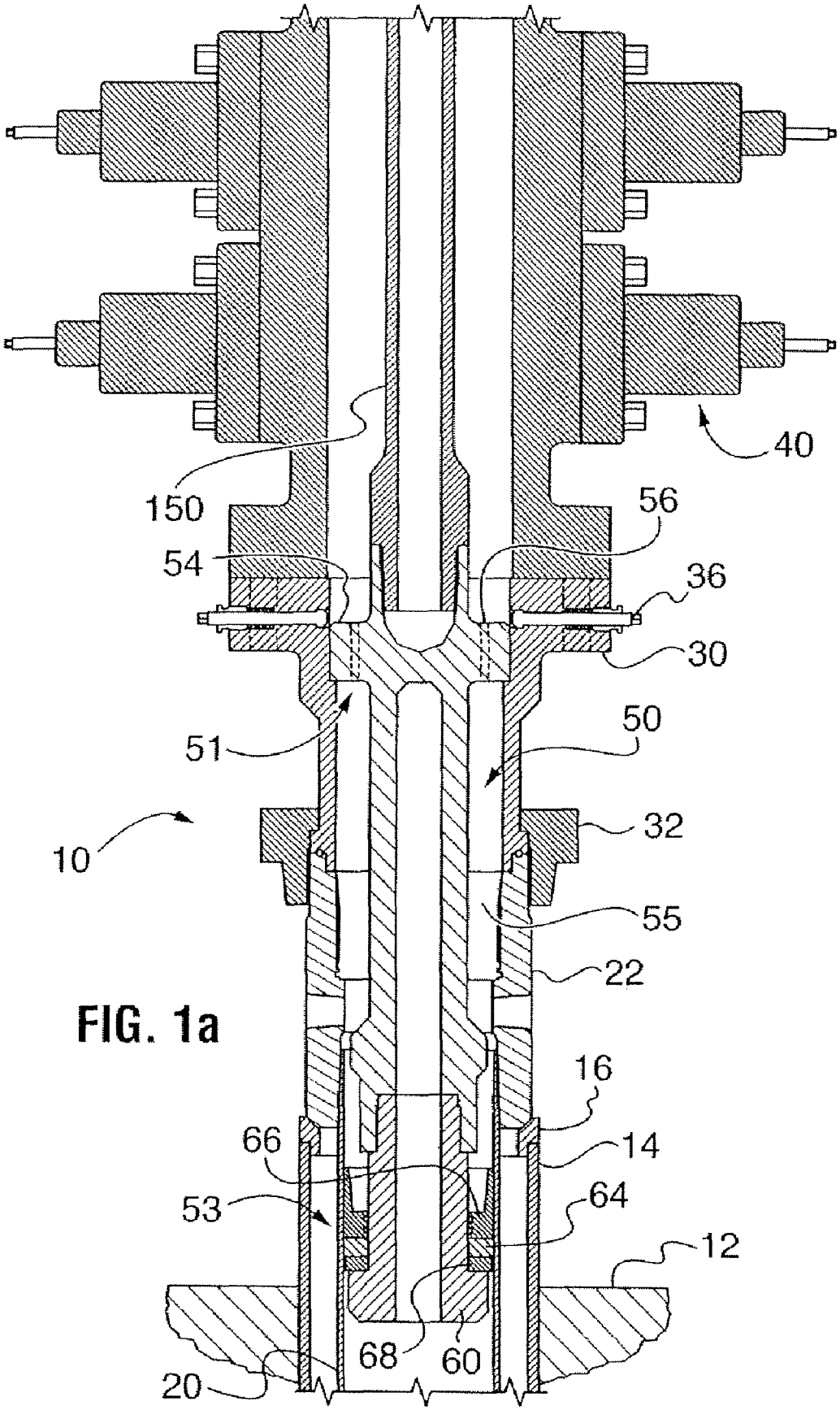
FIG. 1*a* is a cross-sectional view of the wellhead, control stack and test plug tool shown in of FIG. 1, illustrating a landing tool connected to the test plug tool for inserting the test plug tool into the control stack and wellhead.

The test plug hanger 51 of the test plug tool 50 includes a landing joint connector, which is a box threaded socket 52 for receiving one of a pin threaded landing joint 150 as illustrated in FIG. 1*a*, a drill pipe, or a production tubing. In operation, the drill pipe, the production tubing or the landing tool 150 is threaded to the socket 52 and then the test plug tool 50 is lowered into the stack 10 and the test plug is landed inside the casing, as shown in FIG. 1*a*.

The test plug hanger 51 includes a hanger flange 54 that extends laterally from the socket 52 to an outer radius of the test plug hanger 51. The hanger flange 54 has a beveled top edge that is locked in place by the locking pins 36, so that the test plug hanger 51 is restrained from upward movement. In addition, the bottom surface of the hanger flange 54 rests on an annular abutment 31 in the drilling flange 30, which prevents the test plug hanger 51 from moving downwardly through the wellhead control stack. Since the hanger flange 54 is locked between the annular abutment 31 and the heads 38 of the locking pins 36, the test plug tool 50 cannot be displaced during pressurization of the stack 10.

The hanger flange 54 also includes at least one fluid passage 56 that are extends through the test plug hanger. During pressurization of the stack, pressurized fluid flows through the fluid passage 56. The fluid passage 56 thus permits pressure to equalize on both sides of the hanger flange 54.

The test plug tool 50 has a test plug leg 58 integrally formed with the hanger flange 54 and extending downwardly from the underside of the hanger flange 54 to a test plug 53. A bottom end 59 of the test plug leg 58 is threaded to an upper end 61 of a cup tool 60. The test plug leg 58 is preferably hollow to reduce a weight of the test plug tool 50. As illustrated in FIG. 1, the cup tool 60 includes a bullnose 60*a* at the bottom and a cup sleeve 60*b* with an outer diameter less than that of the bullnose 60*a*. Because the bullnose 60*a* has a greater outer diameter than that of the cup sleeve 60*b*, the top surface of the bullnose 60*a* forms an annular shoulder 60*c*. The annular shoulder 60*c* extends in the radial direction but does not contact the surface casing 20. A small annular gap 60*d* remains between the annular shoulder 60*c* and the surface casing 20.

Supported directly above the annular shoulder 60*c* is a metal gauge ring 62. The gauge ring 62 is dimensioned to support an elastomeric sealing element 64 and to inhibit the elastomeric sealing element 64 from extruding between the casing and the bullnose 60*c* when the test plug tool 50 is exposed to elevated fluid pressures. The elastomeric sealing element 64 forms a fluid seal with the surface casing 20 when compressed by an elastomeric cup 66 that is supported directly above the elastomeric sealing element 64. The elastomeric cup 66 is preferably made of nitrile rubber, although persons skilled in the art will appreciate that other elastomers or polymers, such as polyethylene or polystyrene, may also be used. The elastomeric cup 66 is also dimensioned to form a fluid seal against the surface casing 20. The elastomeric cup 66 is bonded to a steel ring that slides over the cup sleeve 60*b*. The steel ring includes a pair of radial grooves for seating two O-rings 68. The O-rings 68 provide a fluid seal between the elastomeric cup 66 and the cup sleeve 60*b*.

During pressure-testing, pressurized fluid flows through the fluid passages 56 in the test plug hanger 51 to pressurize an annular space 55. The annular space 55 is a generally annular volume defined between the test plug leg 58 and the stack 10. The annular space is pressurized to at least an estimated operating pressure, which may be as high as 20,000 PSI (or about 140 MPa). Since the cup 66 is below the wellhead-to-casing joint 26, this joint is subjected to the test pressure. Thus, with the test plug tool 50, it is possible to test the pressure integrity of the wellhead-to-casing joint 26.

Figure 2:
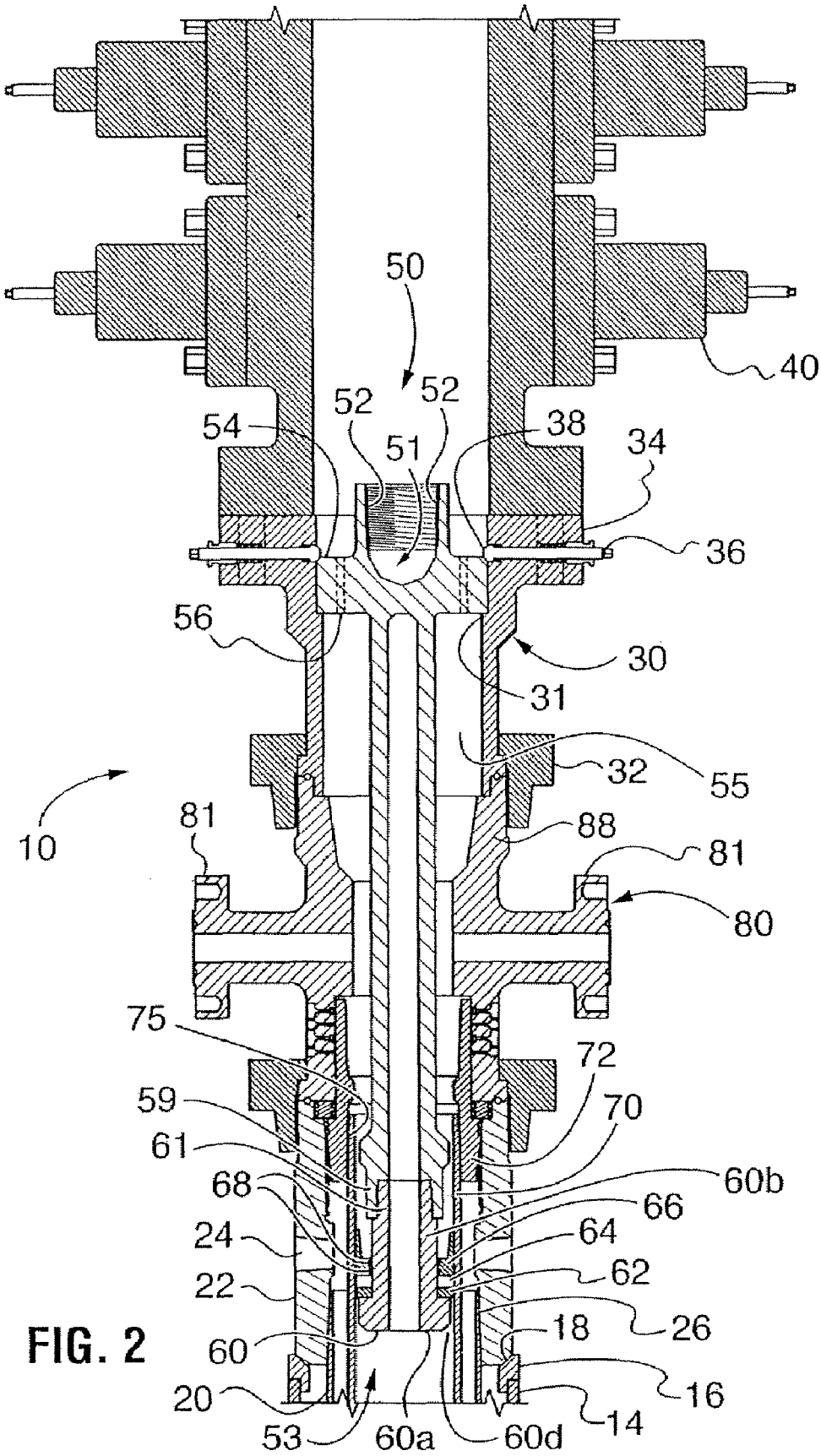
FIG. 2 is a cross-sectional view of a wellhead with a control stack attached thereto and showing a test plug tool in accordance with the invention with the test plug landed in the intermediate casing beneath the joint between the intermediate casing and the intermediate casing mandrel.

As illustrated in FIG. 2, the test plug 50 can be designed and constructed with a smaller outer diameter for use in testing the pressure integrity of a stack 10 configured with an intermediate casing 70 in addition to the surface casing 20. As is known by persons skilled in the art, industry regulations in certain jurisdictions require that intermediate casing be run into the well as a safety measure when exploiting a deep, high-pressure well.

As shown in FIG. 2, the wellhead 22 is seated on the bowl-shaped receptacle 18 of the conductor ring 16 which, in turn, is mounted on the conductor 14. The surface casing 20 is joined to the wellhead 22 below the side ports 24 at a wellhead-to-surface casing joint 26. (These components are configured in the same way as those shown in FIG. 1.)

The wellhead 22 supports an intermediate casing mandrel 72 which is threadedly fastened to the intermediate casing 70 to form a joint with a frusta-conical interface which will be referred to below as an intermediate casing-to-mandrel joint 75.

The drilling flange 30 is secured to an upper end 88 of an intermediate head spool 80 by the wing nut 32. The drilling flange 30 includes lockdown pins 36 in the upper flanged portion 34. A blowout preventer 40 is mounted to the upper flanged portion 34, as described above.

The test plug tool 50 is inserted with a landing tool 150 (shown in FIG. 1*a*) which connects to the box threaded socket 52. The test plug tool 50 is inserted into the stack 10 and positioned at the location shown in FIG. 2, such that the test plug 53 is beneath the intermediate casing-to-mandrel joint 75. The test plug 53 shown in FIG. 2 has a smaller outer diameter than the test plug shown in FIG. 1. To ensure a fluid-tight seal, the cup tool 60, the gauge ring 62, the sealing element 64 and the cup 66 are constructed with diameters appropriate for the size and weight of the intermediate casing, as is understood by persons skilled in the art.

The test plug hanger 51 is secured in place by the locking pins 36 in the upper flanged portion 34 of the drilling flange 30, as already explained above. The heads 38 of the locking pins 36 engage the annular shoulder 54 of the test plug hanger 51 to prevent the test plug from moving upward during pressurization. As also explained above, the fluid passages 56 serve to equilibrate pressure on each side of the test plug hanger 51 during pressurization of the annular space 55.

As illustrated in FIG. 2, because the test plug tool 50 may be inserted beneath the intermediate casing-to-mandrel joint 75, this joint (and all the joints and seals above it in the stack) may be pressure-tested to ensure that they are able to withstand at least the estimated operating pressure.

Figure 3:
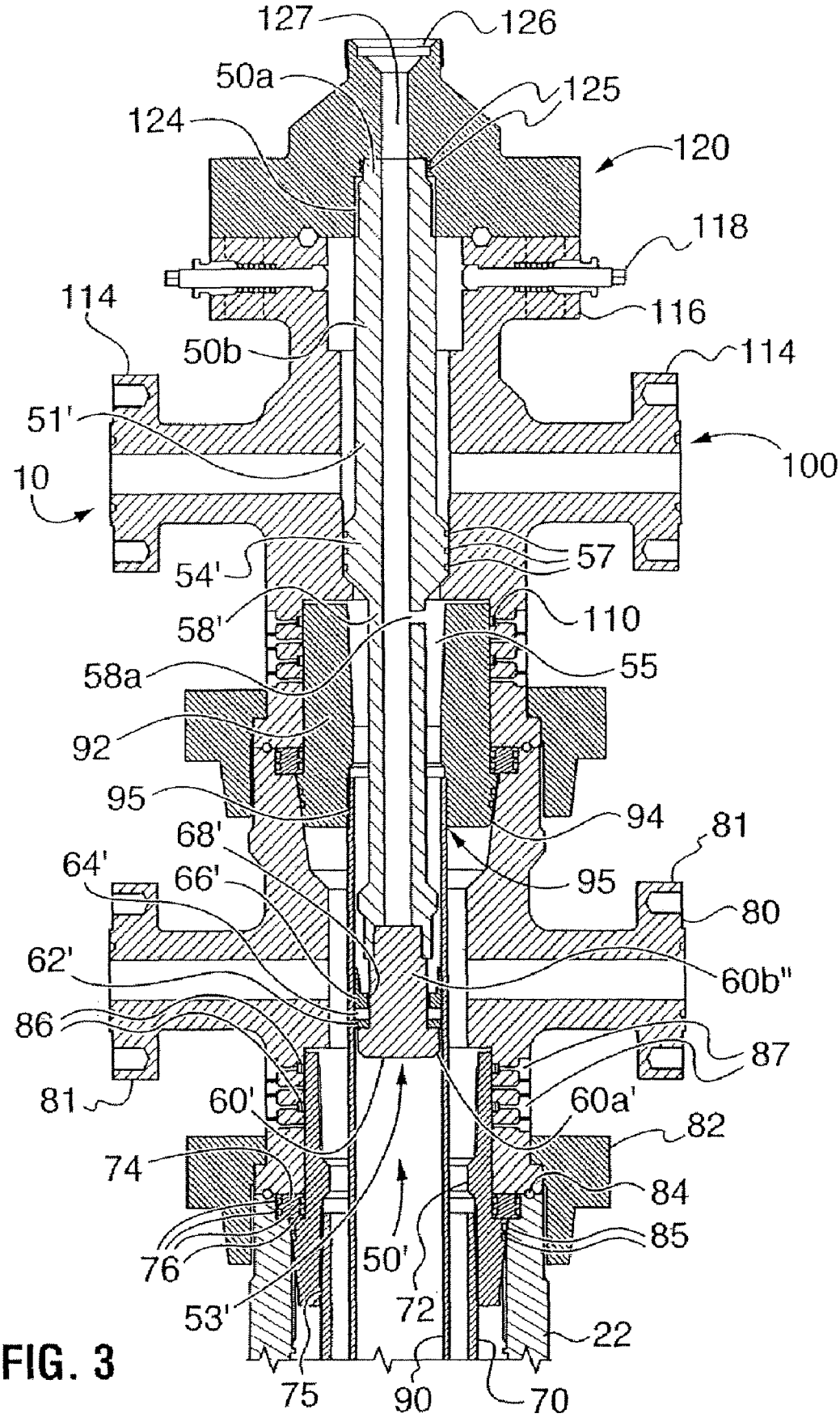
FIG. 3 is a cross-sectional view of a wellhead with a control stack attached thereto and showing a test plug tool in accordance with the invention with the test plug landed in the production casing beneath the joint between the production casing and the production casing mandrel.

FIG. 3 illustrates another embodiment of the test plug tool 50' which is designed to be used in testing the pressure integrity of a production casing 90 which is run inside an intermediate casing 70 for deep well production.

As illustrated, the test plug 53' of the test plug tool 50' resembles the test plug 53 of the test plug tool 50 except that the test plug 53' has a solid cup sleeve 60*b*', whereas the test plug 53 has tubular cup sleeve 60*b*. The reason for this design is explained below. Other than the solid cup sleeve 60*b*', the test plug 53' resembles the test plug 53 in that the cup tool 60' which supports a metal gauge ring 62', a sealing element 64' and an elastomeric cup 66', each of which have a smaller outer diameter than the outer diameter of the test plug of FIG. 2, so as to fit the smaller bore of the production casing 90. The test plug 50' also has O-rings 68' to provide a fluid seal between a steel ring that supports the elastomeric cup 60*b* of the cup tool 60.

The production casing 90 is fastened to a production casing mandrel 92 to form a production casing-to-mandrel joint 95. A flared bottom portion of the production casing mandrel 92 is seated in a bowl-shaped portion 94 of the intermediate spool 80. The intermediate spool 80 is secured to the wellhead 22 by a wing nut 82 as described above with reference to FIG. 2.

A tubing head spool 100 is mounted to a top of the intermediate spool 80. The tubing head spool 100 includes flanged side ports 114 and further includes a top flange 116 which has transverse bores for housing locking pins 118 for securing a tubing mandrel (commonly referred to as a tubing hanger or a "dognut"). A flanged Bowen union 120 is mounted to a top of the top flange 116. The flanged Bowen union 120 has a box threaded socket 124 for receiving a pin threaded upper end 50*a* of the test plug tool 50. The flanged Bowen union 120 also has a pair of annular grooves 125 for seating O-rings for providing a fluid-tight seal between the upper end of the test plug and the flanged Bowen union 120. The flanged Bowen union 120 has at its uppermost end a threaded union 126, a type of connection that is well know in the art for connecting high-pressure lines, or the like. The flanged Bowen union 120 includes an axial passage 127.

The test plug 50' has a differently shaped test plug hanger 51' than the test plug hanger 51 of the embodiment shown in FIGS. 1 and 2. The test plug hanger 51' shown in FIG. 3 includes a hanger flange 54' with beveled shoulders dimensioned to fit snugly in the bore of the tubing head spool 100. The lower beveled shoulder is machined to rest against a bowl-shaped abutment in the tubing head spool 100, which prevents the test plug 50' from descending further into the wellhead stack assembly. Three peripheral grooves 57 are machined into the hanger flange 54'. Three O-rings are seated in the grooves 57 to provide a fluid-tight seal between the test plug hanger 51' and the tubing head spool 100, because the tubing head spool 100 above the tubing hanger bowl is normally not subjected to elevated fluid pressure and the tubing head spool 100 is not necessarily constructed to withstand high fluid pressures.

A fluid passage 58*a* is machined through a sidewall of the test plug leg 58' to permit pressurized fluid to flow through the central bore 127 of the flanged Bowen union 120, through the fluid passage in the sidewall of the test plug leg 58' and into the annular space 55, i.e., the annulus between the test plug leg 58' and the wellhead stack assembly 10. Since pressurized fluid flows below the production casing mandrel joint 95, this joint can be pressure-tested.

In summary, the test plug tools 50, 50' shown in FIGS. 1, 2 and 3 may be dimensioned for use in testing the pressure integrity of pressure control stacks attached to wellheads. As described and illustrated above, the test plug tools may be used to test the pressure integrity of the wellhead-to-surface casing joint (FIG. 1), the intermediate casing mandrel joint (FIG. 2), and the production casing mandrel joint (FIG. 3). In each of these three applications, the test plug tool is also useful for testing the various joints and seals above the wellhead surface casing joint, the intermediate casing mandrel joint, or the production casing mandrel joint, as the case may be, including the rams of blowout preventer(s) located above the wellhead stacks, and any control valves mounted to the wellhead stack 10.

Figure 4:
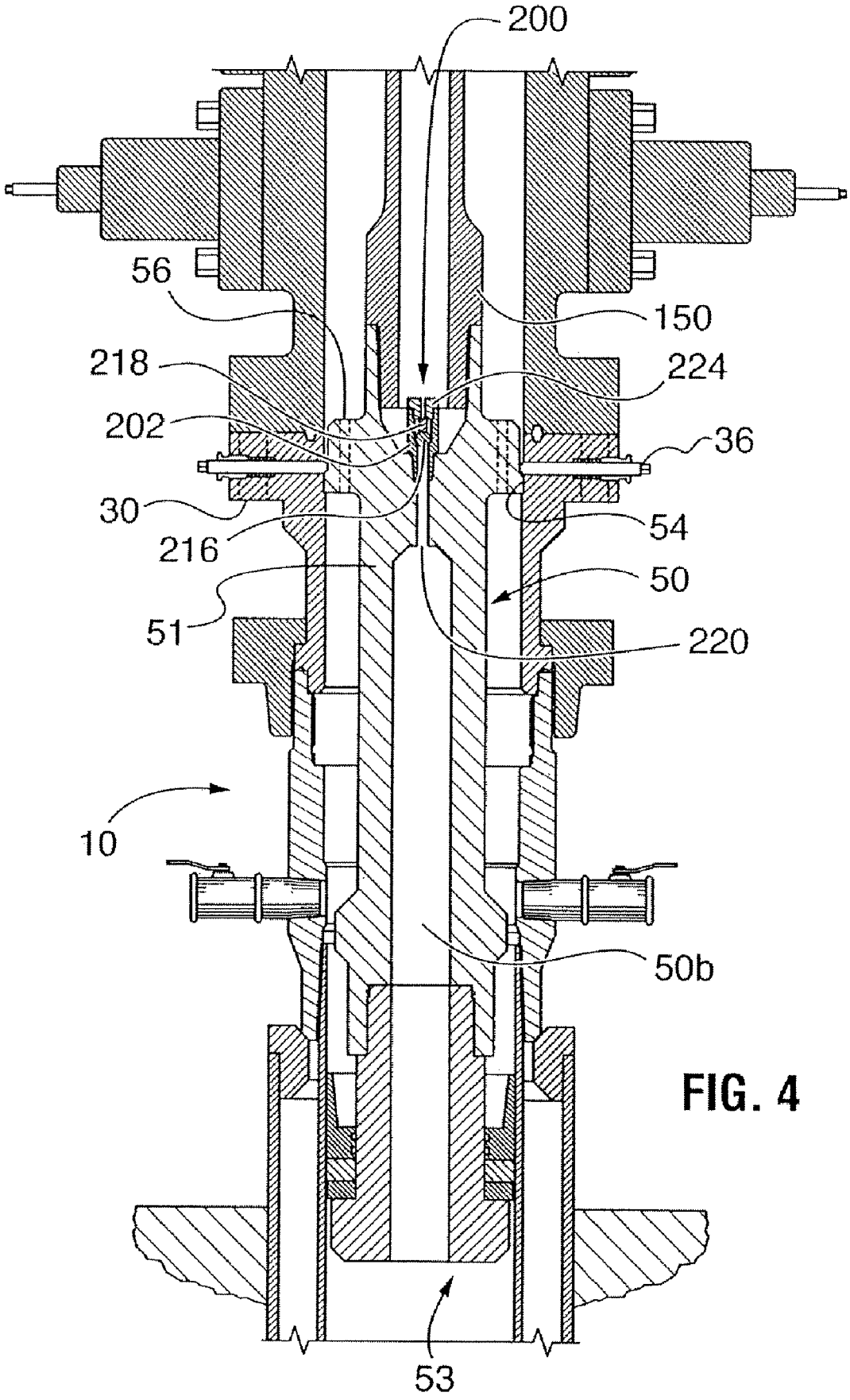
FIG. 4 is a cross-sectional view of a wellhead with a control stack attached thereto and showing a test plug tool equipped with a backpressure valve in accordance with a further embodiment of the invention.

As shown in FIG. 4, the test plug tool 50 may further include a backpressure valve 200 which communicates with an axial passageway 220 in the test plug hanger 51. The backpressure valve is a one-way valve used to ensure that a fluid-tight seal is provided by the test plug tool. If the test plug tool fails to provide a fluid-tight seal, pressurized fluid can leak past the test plug 53, causing backpressure to build up downhole of the test plug tool. Such downhole backpressure may damage the casing or cause other problems.

As shown in FIG. 4, the backpressure valve 200 is a generally annular body 202 with pin threads for engaging a box thread in a test plug hanger 51. The backpressure valve 200 also has a spring-loaded ball valve, which includes a ball 216 that is forced downwardly against an annular shoulder by a spring 218. The spring is retained by an annular retainer cap 224 that threads onto the annular body 202. The structure of the backpressure valve will be described in greater detail below with regard to FIG. 6. In operation, if the test plug tool leaks and backpressure builds up beneath the test plug 53, pressurized fluid will travel up a central bore 50*b* of the test plug tool 50 and up the axial passageway 220. If the backpressure is more than a few pounds per square inch (PSI), the spring-loaded ball valve will be displaced upwardly against the spring, thereby permitting pressurized fluid to flow up a central bore of the landing tool 150, thereby alerting an operator of the leak.

Figure 5:
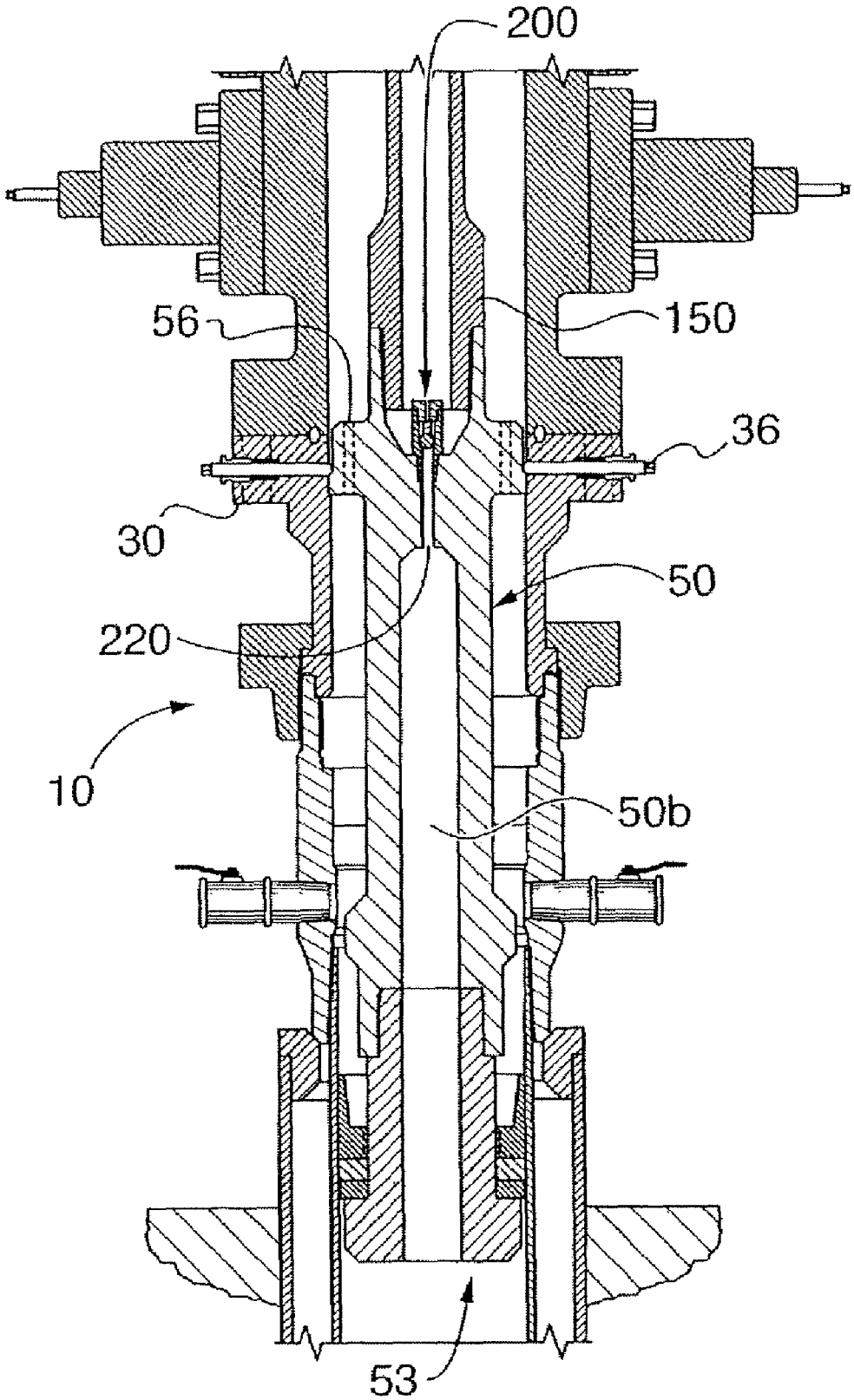
FIG. 5 is a cross-sectional view of a wellhead with a control stack attached thereto and showing a test plug tool equipped with another embodiment of a backpressure valve in accordance with the invention.
Figure 6:
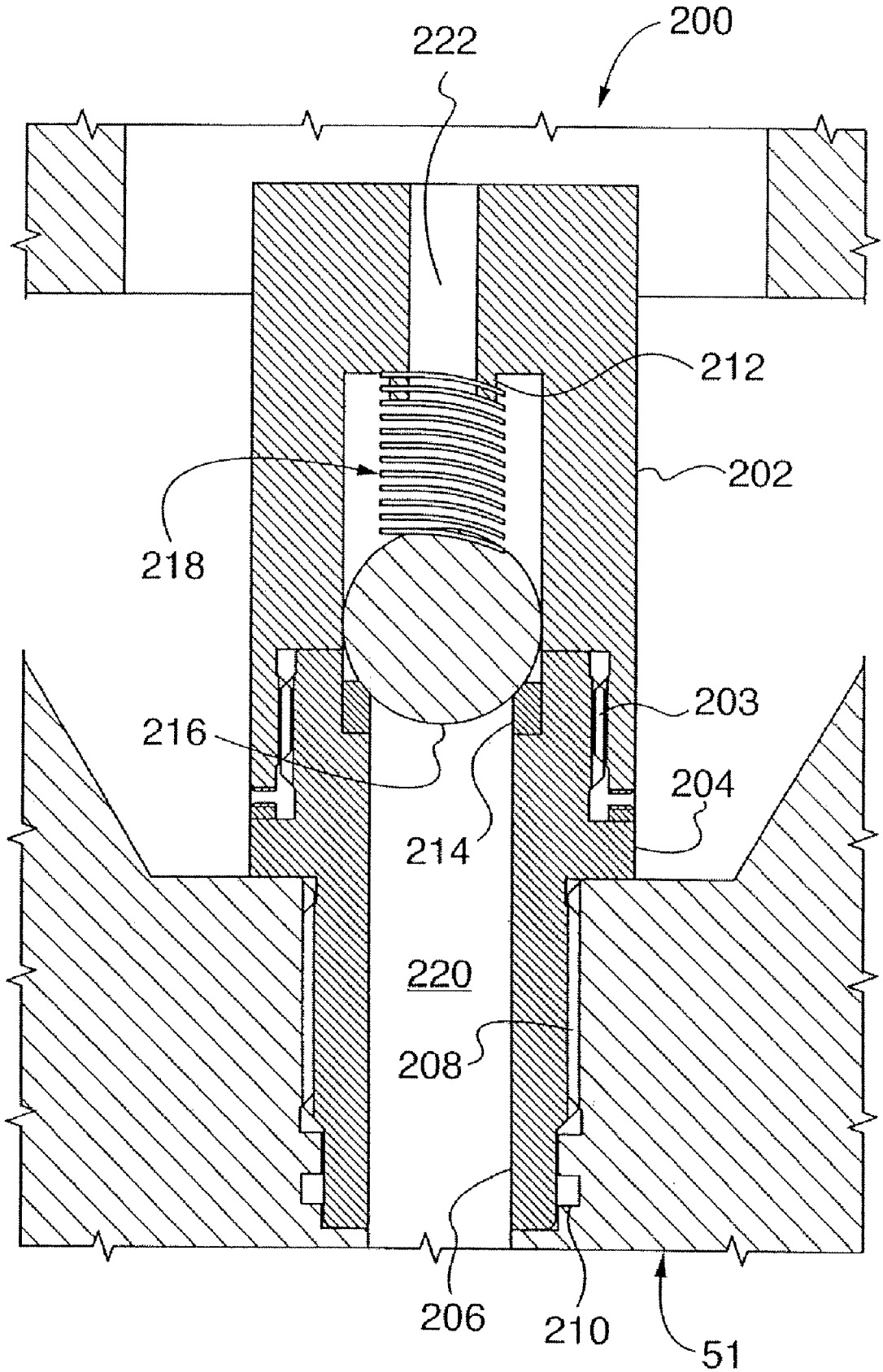
FIG. 6 is a cross-sectional view of the backpressure valve shown in FIG. 5.

FIG. 5 illustrates another embodiment in which the test plug tool 50 employs another embodiment of a backpressure valve 200, the structure of which is illustrated in greater detail in FIG. 6. The backpressure valve 200 shown in FIG. 6 also has a spring-loaded ball valve which is displaced upwardly when the backpressure exceeds the compressive resistance of the spring.

As shown in FIG. 6, the backpressure valve 200 includes a generally annular body 202 which has threads 203 for connecting to an annular anchor that in turn threadedly engages (via threads 208) to the test plug hanger 51. A gasket 210 sits in an annular groove to provide a fluid-tight seal between the test plug hanger 51 and a lower portion 206 of the annular anchor 204.

The backpressure valve includes a ball 216 which is forced downwardly by a compression spring 218 against an annular gasket 214 which sits on an annular shoulder of the anchor 204. The annular shoulder defines an aperture through which pressurized fluid may flow. In other words, the backpressure valve is a one-way spring-loaded ball valve in which the spring exerts a downward force on the ball for obstructing the aperture defined by the annular shoulder.

In operation, if a leak occurs and the backpressure exceeds the compressive resistance of the spring, then the ball is displaced upwardly, thereby permitting pressurized fluid to flow from the axial passageway 220 to an upper passageway 222 and upwards through a central bore 151 of the landing tool 150.

Figure 7:
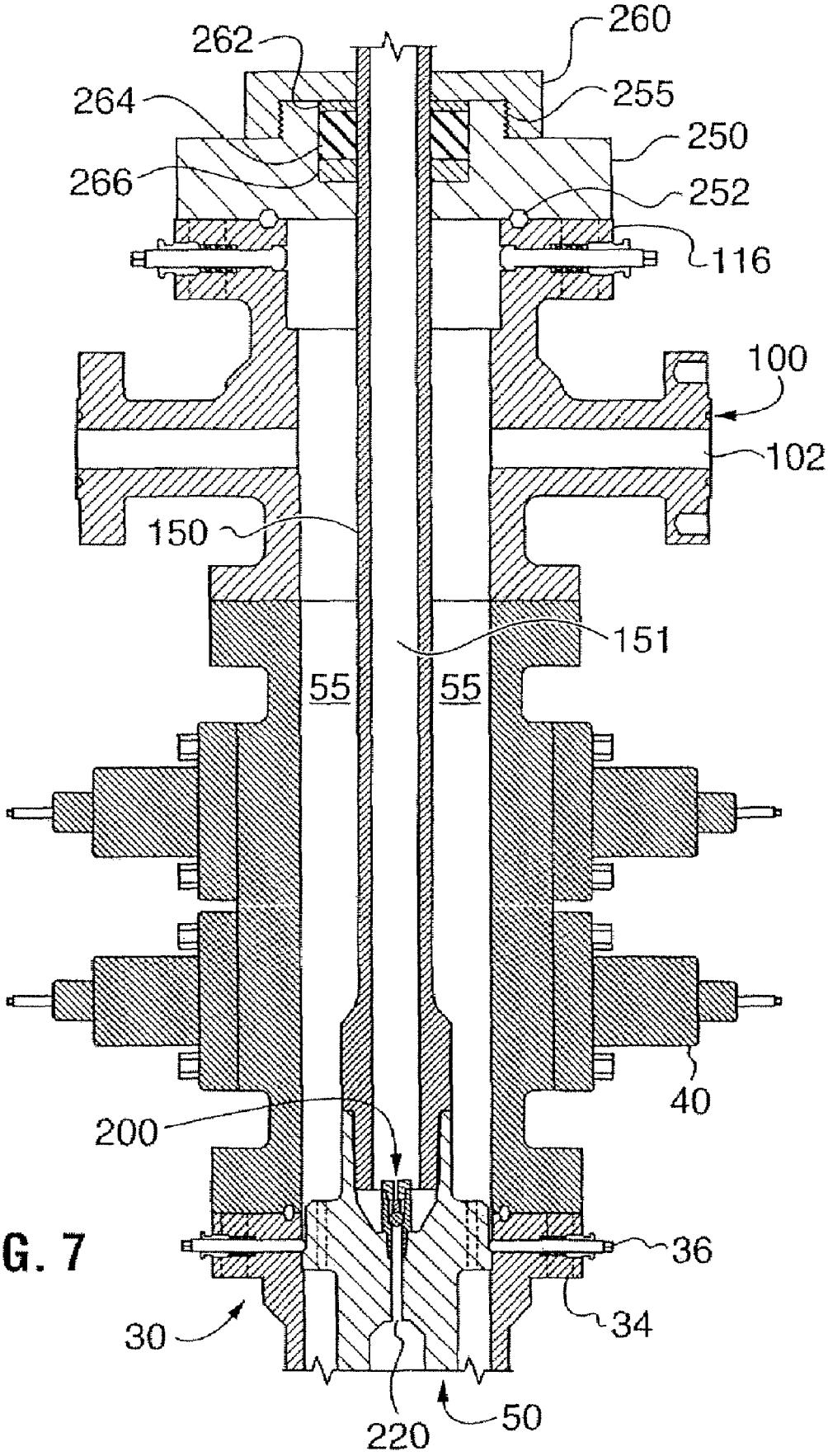
FIG. 7 is a cross-sectional view of an upper portion of a wellhead with a pressurized control stack attached thereto and showing a test plug tool with a backpressure valve in accordance with an embodiment of the invention.

Depicted in FIG. 7 is a set-up for pressurizing the wellhead and control stack. The test plug tool 50 is inserted into the control stack using the landing tool 150 and is locked into place by locking pins 36 in the drilling flange 30. Mounted atop the drilling flange 30 is the blowout preventer 40. Secured atop the blowout preventer 40 is the tubing head spool 100 having flanged side ports 102 for injection of pressurized fluids for testing the pressure integrity of the wellhead and control stack. Secured atop the tubing head spool 100 is a tubing adapter 250. The tubing adapter 250 is flanged to the tubing head spool and is sealed thereto with a ring gasket which is housed in an annular groove 252. The tubing adapter 250 has threads 255 for connection to a retainer nut 260. The tubing adapter also has a radially inward annular cavity known as a stuffing box. The stuffing box houses a packing retainer ring 266, a chevron packing 264 and a packing nut 262. Accordingly, with the control stack configured as shown in FIG. 7, the annular space 55 can be pressurized to test the pressure integrity of the wellhead and control stack. If pressurized fluid leaks past the test plug, backpressure will force open the backpressure valve 200, thereby permitting fluid to flow up the central bore 151 of the landing tool 150.

Persons skilled in the art will appreciate that these test plug tools may be modified to suit similar pressure-testing applications. The embodiments of the invention described above are therefore intended to be exemplary only. The scope of the invention is intended to be limited solely by the scope of the appended claims.

We claim:

1. A test plug tool used to test a pressure integrity of a joint between a production casing to a wellhead stack assembly, comprising:

a tubular member that suspends a test plug in the production casing;

a hanger flange located above the test plug, the hanger flange having a bottom shoulder received in a bowl-shaped abutment above a top end of the production casing in the wellhead stack assembly, and further including at least one peripheral groove for retaining at least one high-pressure seal that provides a fluid seal between the hanger flange and the wellhead stack assembly;

a fluid passage through a sidewall of the tubular member, the fluid passage being located below the hanger above the test plug; and the test plug comprises a cup tool that includes an elastomeric cup for sealing against an inside of the production casing, an annular sealing element compressed against the inside of the production casing by the elastomeric cup, and a gauge ring that inhibits the elastomeric sealing element from being extruded into an annulus between a bullnose and the inside of the production casing.

2. The test plug tool as claimed in claim 1 wherein the at least one high-pressure seal comprises at least one O-ring.

3. The test plug tool as claimed in claim 1 wherein the cup tool comprises a cup sleeve that supports the elastomeric cup and the annular sealing element and terminates in the bullnose, which guides the test plug through the wellhead stack assembly.

4. The test plug tool as claimed in claim 3 wherein the cup sleeve is threadedly connected to a bottom end of the tubular member.

5. The test plug tool as claimed in claim 3 wherein the cup sleeve is solid and seals a bottom of the tubular member.

6. The test plug tool as claimed in claim 1 further comprising a pin threaded end at a top of the tubular member that suspends the test plug.

7. The test plug tool as claimed in claim 6 wherein the pin threaded end at the top of the tubular member connects to a flanged adapter for sealing a top of the wellhead stack assembly.

8. A test plug tool used to test a pressure integrity of a joint between a production casing and wellhead stack assembly, comprising:

a tubular member having a pin threaded top end and a bottom end that suspends a test plug inside the production casing;

a hanger flange located below the pin threaded top end, the hanger flange having a bottom shoulder received in a bowl-shaped abutment in the wellhead stack assembly, the hanger flange including at least one peripheral groove for retaining at least one high-pressure fluid seal that seals between the hanger flange and the wellhead stack assembly;

a fluid passage through a sidewall of the tubular member, the fluid passage communicating with an inside of the tubular member, and is located below the hanger flange and above the bottom end of the tubular member; and the test plug comprises a cup tool comprising an elastomeric cup that engages the inside of the production casing, an annular sealing element compressed against the production casing by the elastomeric cup when the elastomeric cup is subjected to fluid pressure that moves the elastomeric cup against the annular sealing element, and a gauge ring that inhibits extrusion of the annular sealing element into an annulus between the bullnose and the production casing when the elastomeric cup is subjected to the fluid pressure.

9. The test plug tool as claimed in claim 8 wherein the at least one high-pressure seal comprises at least one O-ring seal.

10. The test plug tool as claimed in claim 8 wherein the cup tool further comprises a cup sleeve that supports the elastomeric cup and the annular sealing element and terminates in the bullnose for guiding the test plug through the wellhead stack assembly and into the production casing.

11. The test plug tool as claimed in claim 10 wherein the cup tool is threadedly connected to a bottom end of the tubular member by a pin thread at a top end of the cup sleeve.

12. The test plug tool as claimed in claim 11 wherein the cup sleeve is solid and seals the bottom end of the tubular member.

13. The test plug tool as claimed in claim 8 wherein the pin threaded end at the top of the tubular member connects to a flanged adapter for sealing a top of a tubing head spoo1 at a top of the wellhead stack assembly.

14. A test plug tool used to test a pressure integrity of a joint between a production casing and a wellhead stack assembly, comprising:

a tubular member for suspending a test plug inside a top end of the production casing, the tubular member having a pin threaded top end for threaded engagement with a flanged adapter for sealing a top of the wellhead stack assembly;

a hanger flange located below the pin threaded top end, the hanger flange having a bottom shoulder received in a bowl-shaped abutment in a tubing head spool of the wellhead stack assembly, the hanger flange including at least one peripheral groove for retaining an O-ring seal that provides a fluid seal between the hanger flange and the tubing head spool; and a fluid passage through a sidewall of the tubular member, the fluid passage being located below the hanger flange and above the test plug.

15. The test plug tool as claimed in claim 14 wherein the test plug comprises a cup tool comprising:

a cup sleeve that terminates in a bullnose for guiding the test plug through the wellhead stack assembly and into the production casing;

an elastomeric cup slidably mounted on the cup sleeve and adapted to engage the inside of the production casing when the test plug is inserted into the production casing;

an annular sealing element slidably mounted on the cup sleeve and adapted to be compressed against the production casing by the elastomeric cup when the elastomeric cup is subjected to fluid pressure; and a gauge ring that inhibits extrusion of the sealing element into an annulus between the bullnose and the production casing when the elastomeric cup is subjected to the fluid pressure.

16. The test plug tool as claimed in claim 15 wherein the cup sleeve is solid and the cup tool is threadedly connected to a bottom end of the tubular member by a pin thread at a top end of the cup sleeve, which seals the bottom end of the tubular member.

17. The test plug tool as claimed in claim 14 wherein the pin threaded end at the top of the tubular member connects to the flanged adapter for sealing the top of the tubing head spool and the flanged adapter has a central passage through which test fluid is injected into the tubular member and the fluid passage into the wellhead stack assembly and the top end of the production casing to test the pressure integrity of the joint.

18. The test plug tool as claimed in claim 14 wherein the test plug comprises a cup tool.

19. The test plug tool as claimed in claim 18 wherein the cup tool comprises a top end that threadedly engages a bottom end on the tubular member to suspend the test plug in the top end of the production casing.

20. The test plug tool as claimed in claim 18 wherein the cup tool seals a bottom end of the tubular member.

* * * * *